US007951716B2

(12) United States Patent
Morita et al.

(10) Patent No.: US 7,951,716 B2
(45) Date of Patent: May 31, 2011

(54) WAFER AND METHOD OF PRODUCING THE SAME

(75) Inventors: Etsurou Morita, Tokyo (JP); Kazuo Hujie, Tokyo (JP); Isoroku Ono, Tokyo (JP)

(73) Assignee: Sumco Corporation, Tokyo (JP)

( * ) Notice: Subject to any disclaimer, the term of this patent is extended or adjusted under 35 U.S.C. 154(b) by 726 days.

(21) Appl. No.: 11/707,312

(22) Filed: Feb. 16, 2007

(65) Prior Publication Data

US 2007/0197035 A1 Aug. 23, 2007

(30) Foreign Application Priority Data

Feb. 17, 2006 (JP) ..... 2006-041101

(51) Int. Cl.
*B24B 7/30* (2006.01)
*H01L 21/461* (2006.01)
*C03C 15/00* (2006.01)

(52) U.S. Cl. ..... 438/692; 216/88; 438/693; 438/694; 451/41

(58) Field of Classification Search ..... None
See application file for complete search history.

(56) References Cited

U.S. PATENT DOCUMENTS 6,376,335 B1 4/2002 Zhang et al.
6,576,501 B1 6/2003 Beauchaine et al.
7,192,340 B2 * 3/2007 Ono et al. ..... 451/526
7,718,507 B2 * 5/2010 Morita et al. ..... 438/455
2004/0209554 A1 * 10/2004 Tsumagari et al. ..... 451/36
2005/0255610 A1 11/2005 Sato et al.
2006/0042501 A1 * 3/2006 Miyazaki ..... 106/3
2006/0199353 A1 * 9/2006 Kub et al. ..... 438/455
2006/0258268 A1 * 11/2006 Miyata et al. ..... 451/41
2010/0093882 A1 * 4/2010 Ohama ..... 521/163

FOREIGN PATENT DOCUMENTS

EP 1 717 001 A1 11/2006
EP 1717001 A1 11/2006
JP 2003-257905 A 9/2003
JP 2004-337992 A 12/2004
JP 2005-005490 A 1/2005
JP 2005-129644 A 5/2005
WO WO 01/54178 A1 7/2001

OTHER PUBLICATIONS

European Search Report for Application No. 09006718.2-2302 dated Aug. 28, 2009.
EP Search Report for Application No. 07001408.9 dated May 3, 2007.
European Search Report dated Oct. 29, 2007 for Application No. 07001408.9.

* cited by examiner

*Primary Examiner* — Allan Olsen
(74) *Attorney, Agent, or Firm* — Sughrue Mion, PLLC

(57) ABSTRACT

A wafer is produced at a step of polishing a predetermined face of a wafer to flatten the predetermined face while supplying a polishing liquid onto a bonded abrasive cloth, wherein the bonded abrasive cloth comprises a urethane bonding material consisting of a soft segment having a polyfunctional isocyanate and a hard segment having a polyfunctional polyol and having an expansion ratio of 1.1-4 times and silica having an average particle size of 0.2-10 μm and a hydroxy group, and has a given ratio of the hard segment occupied in the urethane bonding material, a given volume ratio of silica and a given Shore D hardness.

9 Claims, 2 Drawing Sheets

WAFER AND METHOD OF PRODUCING THE SAME

BACKGROUND OF THE INVENTION

1. Field of the Invention

This invention relates to a wafer used, for example, in semiconductors and a method of producing the same, and more particularly to a technique of producing the wafer in which a projection(s) liable to be caused at a rear face of the wafer due to the holding with a wafer-holding jig (hereinafter referred to as a susceptor) in a heat treating step of the wafer can be removed effectively while maintaining a good flatness.

2. Description of Related Art

Recently, the wafer, for example, so-called one-side mirror-finished wafer is particularly demanded to have a severer surface precision from semiconductor device makers. In the production of such a wafer, it frequently tends to conduct a heat treatment (annealing) at a higher temperature above 1100° C. such as treatment for epitaxial growth, annealing treatment accompanied with the miniaturization of the device. In case of conducting such a heat treatment, a micro-projection(s) is easily formed on the rear face of the wafer by taking away a part of a susceptor directly contacting with the rear face of the wafer due to the holding of the wafer in a heat treating furnace. Also, as the heat treating temperature rises, the projection becomes large to finally form a micro-projection having a projection height of not less than 1 μm.

If the micro-projection (having, for example, a height of about 0.5-10 μm) is existent in the rear face of the wafer, when the wafer is chucked under vacuum at a photolithography step in the production of the device, the surface of the wafer is rendered into a somewhat convex-curved face because the completely flat face can not be held. Therefore, the defocusing in the exposure is caused at the surface of the wafer irradiated by the light and the exposure can not be conducted in a high precision, so that there is a fear of lowering the product yield.

For this end, it is required to remove the micro-projections from the wafer by subjecting the rear face to a polishing.

As means for polishing the rear face of the wafer, there are mentioned, for example, a so-called loose abrasive polishing method wherein the rear face of the wafer is polished while feeding a slurry containing loose abrasives such as colloidal silica or the like to a working face of an abrasive cloth of an expandable urethane type obtained by slicing a block of a foamed urethane or an abrasive cloth of a porous non-woven cloth type obtained by impregnating polyurethane into polyester felt as disclosed in JP-A-2005-5490, and a polishing method using a bonded abrasive as disclosed in JP-A-2003-257905, JP-A-2004-337992 and JP-A-2005-129644.

In the polishing method using the loose abrasives as disclosed in JP-A-2005-5490, the micro-projections existing on the rear face of the wafer can be removed as far as they have a certain height (e.g. a height of less than 1 μm). However, when the micro-projections have a height exceeding 1 μm, it is difficult to completely remove such micro-projections.

Also, when the micro-projection having, for example, a height of 1 μm is completely removed by the loose abrasive polishing method, it is required to polish the rear face of the wafer at a total polishing amount of not less than 3 μm. As the total polishing amount becomes large, the flatness is undesirably deteriorated. This tendency becomes particularly remarkable when the size of the wafer is increased from 200 mm to 300 mm together with the rise of the heating temperature for the wafer. Therefore, it is required to develop means for maintaining the flatness by removing the micro-projection having, for example, a height of not less than 1 μm at a less total polishing amount (e.g. not more than 1 μm).

On the other hand, the method using the bonded abrasive as disclosed in JP-A-2003-257905, JP-A-2004-337992 and JP-A-2005-129644 is developed for the purpose of maintaining or improving the polishing performance, but does not utterly consider a point that the micro-projection is removed from the rear face of the wafer at a total polishing amount as small as possible for maintaining the flatness.

SUMMARY OF THE INVENTION

It is an object of the invention to provide a method of producing a wafer in which a micro-projection(s) liable to be caused at a rear face of the wafer due to the holding with a susceptor at a heat treating step of the wafer, particularly a micro-projection(s) having a height of not less than 1 μm can be removed effectively while maintaining a good flatness as well as a wafer produced by this method.

The inventors have made various studies for removing a micro-projection(s) existing in a rear face of a wafer and having a height of more than 1 μm at a less total polishing amount (e.g. not more than 1 μm) to maintain a flatness and found that the micro-projection of not less than 1 μm, e.g. several ten μm can be completely removed by using a particular bonded abrasive cloth instead of the conventional loose abrasive polishing, and as a result, the invention has been accomplished. That is, the gist and construction of the invention are as follows.

(1) A method of producing a wafer which comprises a step of polishing a predetermined face of a wafer to flatten the predetermined face while supplying a polishing liquid onto a bonded abrasive cloth, wherein the bonded abrasive cloth comprises a urethane bonding material consisting of a soft segment having a polyfunctional isocyanate and a hard segment having a polyfunctional polyol and having an expansion ratio of 1.1-4 times and silica having an average particle size of 0.2-10 μm and a hydroxy group, and a ratio of the hard segment occupied in the urethane bonding material is 40-55% as a molecular weight ratio, and a volume ratio of silica in the whole of the bonded abrasive cloth is within a range of 20-60%, and a Shore D hardness of the bonded abrasive cloth is 40-80.

(2) A method of producing a wafer according to item (1), wherein the predetermined face of the wafer is a rear face having a micro-projection(s) and the micro-projection is removed at a total polishing amount through a polishing.

(3) A method of producing a wafer according to item (2), wherein the total polishing amount is not more than 1 μm.

(4) A method of producing a wafer according to item (1), (2) or (3), wherein the wafer before the polishing step is a wafer after a heat treatment at a high temperature above 1100° C.

(5) A method of producing a wafer according to any one of items (1)-(4), wherein the wafer has a diameter of not less than 300 mm.

(6) A method of producing a wafer according to any one of items (1)-(5), wherein the polishing liquid is an alkali solution having a pH of 10-13.

(7) A method of producing a wafer according to any one of items (1)-(6), wherein the surface of the wafer is formed with a protection film prior to the polishing.

(8) A method of producing a wafer according to item (7), wherein the protection film is a thermal-oxidative film.

(9) A method of producing a wafer according to item (7), wherein the protection film is a tape seal used at the polishing step for the rear face of the wafer.

(10) A method of producing a wafer according to any one of items (1)-(9), wherein the polishing is carried out with a sheet-feed polishing machine.

(11) A method of producing a wafer according to item (10), wherein the polishing machine is provided with a position controlling function.

(12) A wafer heat-treated above 1100° C. and having a diameter of not less than 300 mm, wherein a micro-projection (s) having a height of not less than 10 nm is not existent on a rear surface of the wafer and a flatness (GBIR) of the wafer is not more than 0.35 μm.

According to the invention, the micro-projection liable to be generated on the rear face of the wafer due to the keeping with a susceptor, particularly micro-projection of not less than 1 μm can be removed effectively at a step of heat-treating the wafer while maintaining a good flatness (GBIR).

BRIEF DESCRIPTION OF THE DRAWING

The invention will be described with reference to the accompanying drawings, wherein.

DESCRIPTION OF THE PREFERRED EMBODIMENTS

Figure 1:
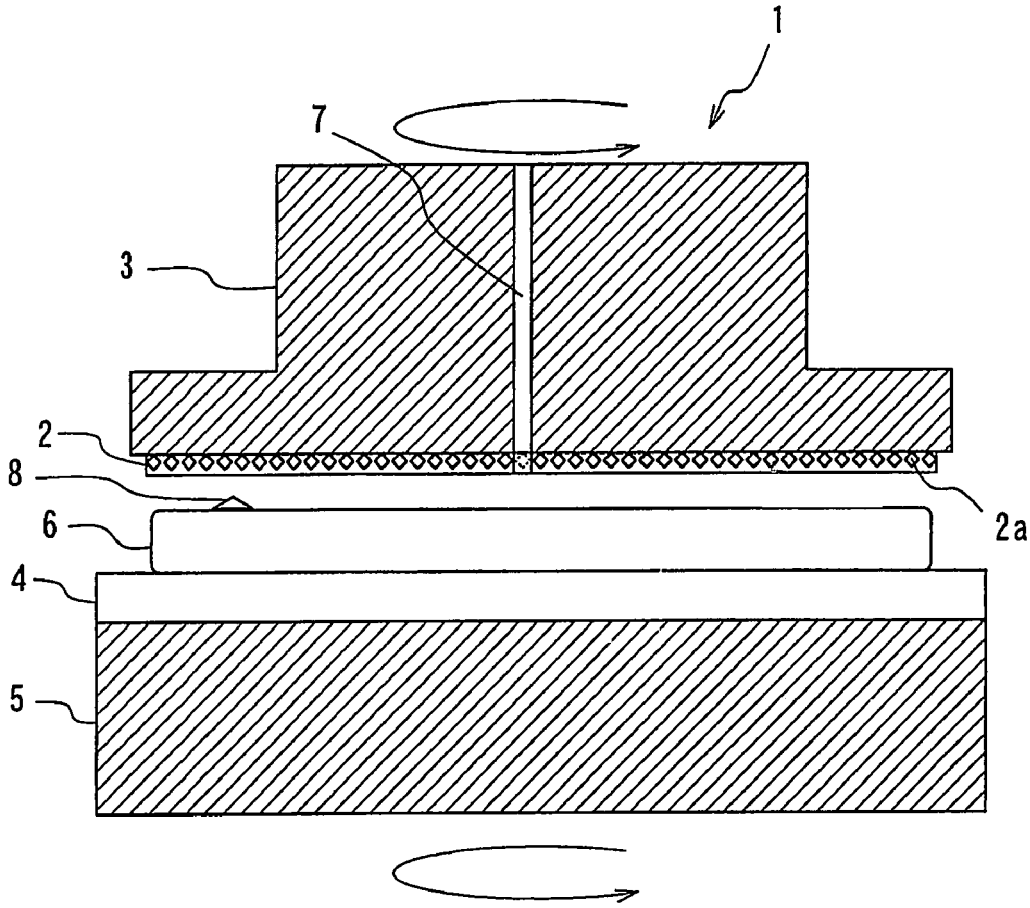
FIG. 1 is a schematic view of a main part of a sheet-feed polishing machine suitable for use in the production method of the invention illustrating a state just before polishing.

In the invention, the semiconductor wafer is not particularly limited, and includes, for example, a silicon wafer, a gallium arsenide wafer (GaAs wafer), a laminated wafer of a laminated SOI substrate, a SIMOX wafer, a semiconductor wafer heat-treated in an atmosphere of hydrogen gas or argon gas, a RTA-treated wafer, an epitaxial wafer and the like. Moreover, RTA is an abbreviation of Rapid Thermal Annealing, and the RTA wafer is a wafer subjected to a heat treatment by rapidly heating a semiconductor wafer.

Also, when the wafer is subjected to the heat treatment at a temperature above 1100° C., preferably above 1300° C. prior to the polishing, a micro-projection(s) having a height of not less than 1 μm is liable to be easily generated on a rear face of the wafer, so that the invention particularly develops a remarkable effect when the polishing step is applied to the wafer after the heat treatment at such a higher temperature.

In addition, as the diameter of the wafer becomes large, the flatness of the polished face through the polishing is hardly maintained. The invention develops a remarkable effect when the polishing step is applied to the wafer having a larger diameter, concretely the wafer having a diameter of not less than 300 mm.

The invention is concerned with a method of producing a wafer which comprises a step of polishing a predetermined face of a wafer to flatten the predetermined face while supplying a polishing liquid onto a bonded abrasive cloth.

The "predetermined face" of the wafer includes front and rear faces of the wafer but also side face thereof. In the invention, however, it is preferable that the polishing is particularly applied to the rear face of the wafer liable to generate the micro-projection when the heat treatment at the high temperature above 1100° C.

The main feature of the invention lies in that a specific bonded abrasive cloth is used as a means for polishing the wafer. More concretely, the bonded abrasive cloth comprises a urethane bonding material consisting of a soft segment having a polyfunctional isocyanate and a hard segment having a polyfunctional polyol and having an expansion ratio of 1.1-4 times and silica having an average particle size of 0.2-10 μm and a hydroxy group, and a ratio of the hard segment occupied in the urethane bonding material is 40-55% as a molecular weight ratio, and a volume ratio of silica in the whole of the bonded abrasive cloth is within a range of 20-60%, and a Shore D hardness of the bonded abrasive cloth is 40-80.

In the invention, the predetermined face of the wafer, particularly the rear face including the micro-projection is polished by using the bonded abrasive cloth of the above construction, whereby the micro-projection liable to be generated at the rear face of the wafer resulting from the keeping with the susceptor, particularly micro-projection of not less than 1 μm can be removed effectively while maintaining the good flatness.

The reason why the expansion ratio of the urethane bonding material is limited to 1.1-4 times is due to the fact that when it is less than 1.1 times, the material becomes too hard and the wafer is easily damaged, while when it exceeds 4 times, the material becomes too soft and the micro-projection can not be removed from the rear face of the wafer sufficiently.

It is preferable that the ratio of the hard segment occupied in the urethane bonding material is 40-55% as a molecular weight ratio. When it is less than 40%, the sufficient hardness is not obtained and it is difficult to remove the micro-projection at a less total polishing amount, while when it exceeds 55%, the hardness is too high and flaws such as scratch and the like are formed on the polished face of the wafer. Although such flaws are a level capable of removing by a subsequent finish polishing, the invention omits the finish polishing, so that the upper limit of the hard segment ratio in the urethane bonding material is rendered into 55%.

The reason why the average particle size of silica is limited to 0.2-10 μm is due to the fact that when it is less than 0.2 μm, the micro-projection can not be removed sufficiently from the rear face of the wafer, while when it exceeds 10 μm, the flaws are liable to be caused on the rear face of the wafer. Although such flaws are a level capable of removing by a subsequent finish polishing, the invention omits the finish polishing, so that the upper limit of the average particle size of silica is rendered into 10 μm.

The reason why silica has a hydroxy group is based on the fact that the compatibility with the urethane bonding material becomes good.

The reason why the volume ratio of silica in the whole of the bonded abrasive cloth is limited to 20-60% is due to the fact that when it is less than 20%, the micro-projection can not be removed sufficiently from the rear face of the wafer, while when it exceeds 60%, the flaws are liable to be easily generated on the rear face of the wafer.

The reason why the Shore D hardness of the bonded abrasive cloth is limited to 40-80 is due to the fact that when it is less than 40, the cloth becomes too soft and the cloth becomes too hard and the micro-projection can not be removed sufficiently from the rear face of the wafer, while when it exceeds 80, the flaws are liable to be easily generated on the rear face of the wafer. Although such flaws are a level capable of removing by a subsequent finish polishing, the invention omits the finish polishing, so that the upper limit of the Shore D hardness is rendered into 80.

At this moment, the Shore D hardness is measured according to a method defined in JIS K6253-1997 or ISO 7619.

In the invention having the above construction, therefore, the micro-projection(s) can be effectively removed from the rear face of the wafer while maintaining the good flatness.

Particularly, according to the invention, the rear face of the wafer provided with the micro-projection(s) is polished by using the bonded abrasive cloth having the above construction, whereby the micro-projection(s) can be removed at a less total polishing amount. For example, when the rear face of the wafer subjected to the heat treatment above 1100° C. and having a diameter of not less than 300 mm is polished to completely remove the micro-projection having a height of about 1 μm from the rear face of the wafer, the total polishing amount over the whole of the rear face of the wafer is required to be about 3 μm in the conventional polishing method using the loose abrasives, but according to the invention the total polishing amount can be reduced to not more than 1 μm and hence the deterioration of the flatness can be suppressed. From a viewpoint of the maintenance of the flatness, the total polishing amount is preferable to be not more than 1 μn, while the total polishing amount is preferable to be not less than 0.2 μm from a viewpoint that the micro-projection is removed completely.

The polishing step of the invention is not the conventional mechanical polishing using the bonded abrasives, but is carried out by a mechanochemical polishing while feeding a polishing liquid onto the bonded abrasive cloth. As the polishing liquid is preferable an alkali solution having a PH of 10-13. When the pH value is outside the above range, the polishing rate lowers and the treating time becomes long. As the alkali solution are mentioned a solution of sodium hydroxide (NaOH), a solution of potassium hydroxide (KOH) and the like.

In case of polishing the rear face of the wafer, it is required to form a protection film before the polishing so as not to form flaws on the front face of the wafer. As the protection film is preferably used a thermal-oxidative film formed by heat-treating in an oxidizing atmosphere, or a tape seal used in the step of polishing the rear face of the wafer.

The protection film is preferable to have a thickness of 200-400 nm. When the thickness is less than 200 nm, there is a fear of badly affecting a chuck used in the polishing to the face of the wafer, while when it exceeds 400 nm, the treating time for removing the protection film becomes long and the warping is caused in the wafer and the evaluation of the flatness can not be conducted.

Figure 2:
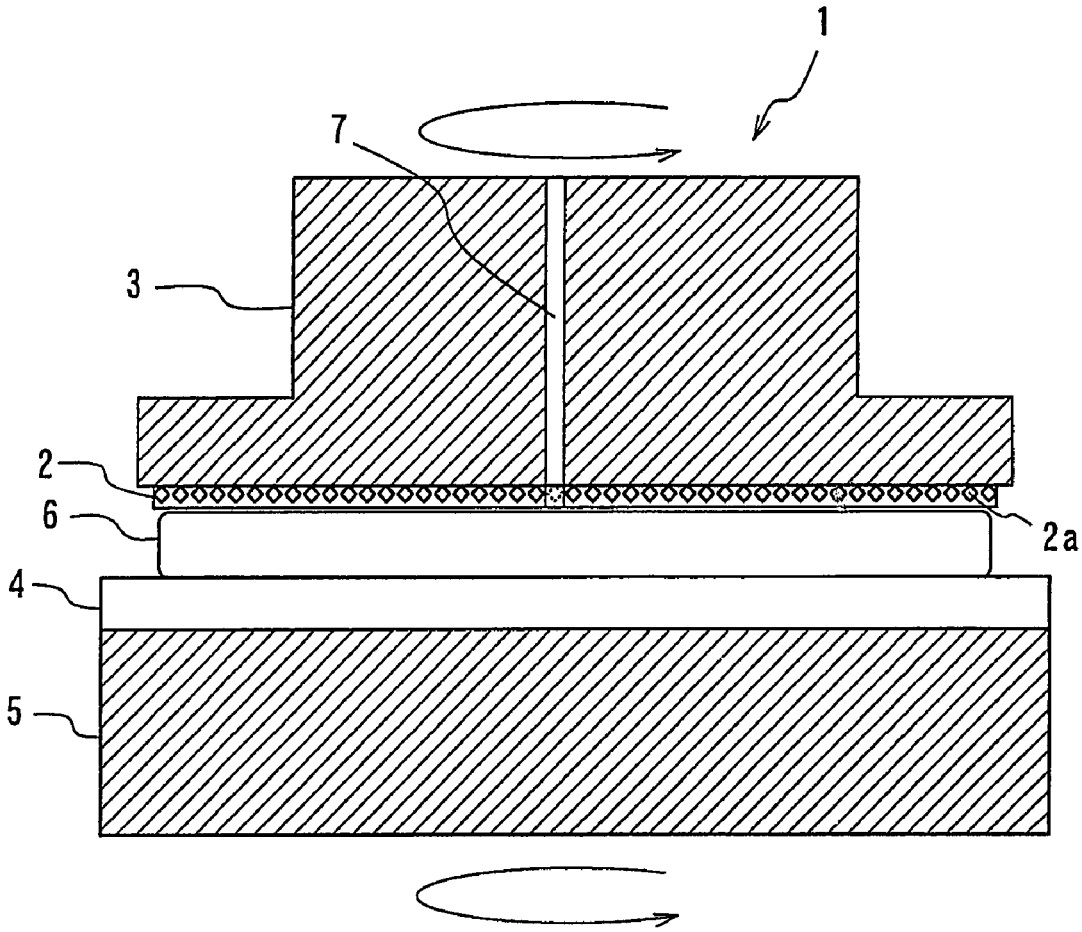
FIG. 2 is a schematic view of a main part of a sheet-feed polishing machine suitable for use in the production method of the invention illustrating a polishing state.

Also, the polishing is preferable to be carried out by using a sheet-feed polishing machine. In FIGS. 1 and 2 is shown an outline of a main part of the sheet-feed polishing machine suitable for use in the production method of the invention wherein FIG. 1 shows a state before the polishing and FIG. 2 shows a polishing state.

The illustrated sheet-feed polishing machine 1 comprises a rigid head 3 provided on its surface with a bonded abrasive cloth 2 embedding many abrasives 2*a* therein and a polishing table 5 attached on its surface with an adsorption pad 4 and keeping a wafer 6 without inclining it. In the illustrated embodiment, a front face of the wafer 6 provided with a protection film is placed and fixed onto the polishing table 5 and the bonded abrasive cloth 2 is moved downward up to a predetermined position from above to polish the rear face of the wafer 6 while supplying a polishing liquid through a conduit 7 formed in a central position of the head 3.

Moreover, the polishing machine 1 is preferable to be provided with a position controlling function because only a micro-projection(s) 8 existing on the rear face of the wafer can be removed effectively at a slight total polishing amount.

By the method according to the invention can be obtained a wafer having a smooth rear face without micro-projection(s) while maintaining a good flatness of not more than 1.0, which has been hardly attained in the conventional polishing method, particularly a wafer heat-treated at a high temperature above 1100° C. and having a diameter of not less than 300 mm.

Although the above is described with reference to only an embodiment of the invention, various modifications may be added within a scope of the invention.

There are prepared wafers by using the method according to the invention and the performances thereof are evaluated by the following method.

Example 1

A rear face of a SIMOX wafer having a diameter of 300 mm and annealed at 1350° C. is polished as follows. The polishing of the rear face is a system in which the wafer is polished at a state of keeping with water as shown in FIG. 1. By using a sheet-feed polishing machine is conducted the polishing of the rear face while supplying an alkali solution of KOH having pH of 11 as a polishing liquid onto a bonded abrasive cloth, which has a urethane bonding material consisting of a soft segment having a polyfunctional isocyanate and a hard segment having a polyfunctional polyol and having an expansion ratio of 2 times and silica having an average particle size of 2 μm and a hydroxy group and a ratio of the hard segment in the urethane bonding material of 50% as a molecular weight ratio, a volume ratio of silica of 40% and a Shore D hardness of 55, at a state of positioning the bonded abrasive cloth to the rear face of the wafer as shown in FIG. 2. Moreover, as the rear face of the wafer is observed before the polishing, 20 micro-projections of about 4 μm on average are existent on the rear face. In the polishing, a thermal-oxidative film having a thickness of 300 nm is formed as a protection film on the front face of the wafer.

Example 2

The rear face of the wafer is polished in the same manner as in Example 1 except that the average particle size of silica is 0.2 μm.

Example 3

The rear face of the wafer is polished in the same manner as in Example 1 except that the average particle size of silica is 10 μm.

Comparative Example 1

The rear face of the wafer is polished by a loose abrasive polishing method described in JP-A-2005-5490.

Comparative Example 2

The rear face of the wafer is polished by using the conventionally used urethane type abrasive cloth as an abrasive cloth.

Comparative Example 3

The rear face of the wafer is polished in the same manner as in Example 1 except that the average particle size of silica is 0.15 μm.

Comparative Example 4

The rear face of the wafer is polished in the same manner as in Example 1 except that the average particle size of silica is 20 μm.

Test Method

With respect to the thus polished rear faces of the wafers, the height of the micro-projection against the total polishing amount on the rear face, flatness (GBIR) and the presence or absence of flaw on the rear face of the wafer after the polishing are measured to evaluate the performances of the each wafer. The evaluated results are shown in Tables 1-3.

Moreover, the height of the micro-projection is measured by a contact type dick tuck. The flatness (GBIR) is measured by using an electrostatic capacity type flatness measuring apparatus (trade name: AFS, made by ADE Co., Ltd.).

TABLE 1

Relation between total polishing amount (μm) and height of micro-projection (nm)

| | Total polishing amount (μm) | | | | | | | |
|---|---|---|---|---|---|---|---|---|
| | Initial | 0.2 | 0.5 | 1 | 1.5 | 2 | 5 | 7 |
| Comparative Example 1 | 4000 | — | — | — | — | 338 | 98 | 0 |
| Comparative Example 2 | 4000 | — | — | — | — | 861 | 379 | 145 |
| Comparative Example 3 | 4000 | 2235 | 1023 | 325 | 0 | 0 | 0 | — |
| Comparative Example 4 | 4000 | 0 | 0 | 0 | 0 | 0 | — | — |
| Example 1 | 4000 | 0 | 0 | 0 | 0 | 0 | — | — |
| Example 2 | 4000 | 1154 | 120 | 0 | 0 | 0 | — | — |
| Example 3 | 4000 | 0 | 0 | 0 | 0 | 0 | — | — |

TABLE 2

Relation between total polishing amount (μm) and flatness (μm)

| | Total polishing amount (μm) | | | | | | | |
|---|---|---|---|---|---|---|---|---|
| | Initial | 0.2 | 0.5 | 1 | 1.5 | 2 | 5 | 7 |
| Comparative Example 1 | 0.3 | — | — | — | — | 0.65 | 1.2 | 2.1 |
| Comparative Example 2 | 0.3 | — | — | — | — | 0.82 | 1.8 | 2.5 |
| Comparative Example 3 | 0.3 | 0.3 | 0.3 | 0.3 | 0.39 | 0.61 | 0.95 | — |
| Comparative Example 4 | 0.3 | 0.3 | 0.3 | 0.3 | 0.36 | 0.55 | — | — |
| Example 1 | 0.3 | 0.3 | 0.3 | 0.3 | 0.35 | 0.51 | — | — |
| Example 2 | 0.3 | 0.3 | 0.3 | 0.3 | 0.37 | 0.56 | — | — |
| Example 3 | 0.3 | 0.3 | 0.3 | 0.3 | 0.35 | 0.52 | — | — |

TABLE 3

Relation between total polishing amount (μm) and flaw

| | Total polishing amount (μm) | | | | | | | |
|---|---|---|---|---|---|---|---|---|
| | Initial | 0.2 | 0.5 | 1 | 1.5 | 2 | 5 | 7 |
| Comparative Example 1 | absence | — | — | — | — | absence | absence | absence |
| Comparative Example 2 | absence | — | — | — | — | absence | absence | absence |
| Comparative Example 3 | absence | absence | absence | absence | absence | absence | absence | — |
| Comparative Example 4 | absence | presence | presence | presence | presence | presence | — | — |
| Example 1 | absence | absence | absence | absence | absence | absence | — | — |
| Example 2 | absence | absence | absence | absence | absence | absence | — | — |
| Example 3 | absence | absence | absence | absence | absence | absence | — | — |

As seen from the results of Tables 1-3, in all of Examples 1-3, the micro-projections are completely removed even when the total polishing amount to the rear face of the wafer is 1 μm at maximum, and the flatness is 0.3 μm and is equal to the level before the polishing.

On the contrary, the total polishing amount in Comparative Example 1 is required to be not less than 7 μm, while in Comparative Example 2 the micro-projections can not be removed and are existent on the rear face of the wafer even at the total polishing amount of 7 μm, and the flatness is considerably deteriorated as compared with the flatness before the polishing as shown in Table 2. In Comparative Example 3, the micro-projections can be removed completely at the total polishing amount of 1.5 μm, but can not be removed at the total polishing amount of 1 μm. In Comparative Example 4, the removal of the micro-projections and the flatness are the same as in Example 3, but the flaws are observed on the rear face of the wafer after the polishing as shown in Table 3.

According to the invention, there can be provided a method of producing a wafer in which a micro-projection(s) liable to be caused at a rear face of the wafer due to the holding with a susceptor at a heat treating step of the wafer, particularly a micro-projection(s) having a height of not less than 1 μm can be removed effectively while maintaining a good flatness as well as a wafer produced by this method.

What is claimed is:

1. A method of producing a wafer which comprises a step of polishing a predetermined face of a wafer to flatten the predetermined face while supplying a polishing liquid onto a bonded abrasive cloth, wherein the bonded abrasive cloth comprises a urethane bonding material consisting of a soft segment having a polyfunctional isocyanate and a hard segment having a polyfunctional polyol and having an expansion ratio of 1.1-4 times and silica having an average particle size of 0.2-10 μm and a hydroxy group, and a ratio of the hard segment occupied in the urethane bonding material is 40-55% as a molecular weight ratio, and a volume ratio of silica in the whole of the bonded abrasive cloth is within a range of 20-60%, and a Shore D hardness of the bonded abrasive cloth is 40-80;

wherein the polishing is carried out with a sheet-feed polishing machine;

wherein the polishing machine is provided with a controlling function which removes only a micro-projection existing on a rear surface of the wafer.

2. A method of producing a wafer according to claim 1, wherein the predetermined face of the wafer is a rear face having a micro-projection(s) and the micro-projection is removed at a total polishing amount through a polishing.

3. A method of producing a wafer according to claim 2, wherein the total polishing amount is not more than 1 μm.

4. A method of producing a wafer according to claim 1, 2 or 3, wherein the wafer before the polishing step is a wafer after a heat treatment at a high temperature above 1100° C.

5. A method of producing a wafer according to any one of claims 1 to 3, wherein the wafer has a diameter of not less than 300 mm.

6. A method of producing a wafer according to any one of claims 1 to 3, wherein the polishing liquid is an alkali solution having a pH of 10-13.

7. A method of producing a wafer according to any one of claims 1 to 3, wherein the surface of the wafer is formed with a protection film prior to the polishing.

8. A method of producing a wafer according to claim 7, wherein the protection film is a thermal-oxidative film.

9. A method of producing a wafer according to claim 7, wherein the protection film is a tape seal used at the polishing step for the rear face of the wafer.

* * * * *